United States Patent [19]

Cunningham

[11] 4,029,014

[45] June 14, 1977

[54] SAFETY IGNITER FOR FLARES

[75] Inventor: Donald J. Cunningham, North Ogden, Utah

[73] Assignee: Thiokol Corporation, Newtown, Pa.

[22] Filed: Feb. 23, 1976

[21] Appl. No.: 660,097

[52] U.S. Cl. ..... 102/35; 102/76 R; 102/85.6

[51] Int. Cl.[2] ..... F42B 4/12

[58] Field of Search ..... 102/35 R, 35.2, 35.4, 102/35.6, 34.1, 76 R, 76 P, 78, 81, 81.2, 81.6, 85.6, 86.2; 89/1.5 A, 1.5 D

[56] References Cited

UNITED STATES PATENTS

| | | | |
|---|---|---|---|
| 1,683,940 | 9/1928 | Wiley | 102/35 |
| 1,771,455 | 7/1930 | Wiley | 102/35 |
| 1,774,535 | 9/1930 | Wiley | 102/35 |
| 2,112,614 | 3/1938 | Wiley | 102/85.6 X |
| 2,666,390 | 1/1954 | Brandt | 102/78 |
| 3,712,232 | 1/1973 | Abel | 89/1.5 D |
| 3,736,877 | 6/1973 | Roberts et al. | 102/35 |

*Primary Examiner*—Harold Tudor
*Attorney, Agent, or Firm*—Stanley A. Marcus; Edward E. McCullough

[57] ABSTRACT

A safety igniter for flares is attachable to the flare parachute by a lanyard that operates the igniter when the parachute opens. The igniter is packaged in a housing that is mounted into the flare casing adjacent the ignition surface of the flare candle. The housing has two contiguous bores of different diameters, the larger bore containing a primer-charge holder and a firing-pin holder, both of which are movable in the bore. The primer-charge holder is retained adjacent the shoulder at the juncture of the bores, so that its motion is rotational only; while that of the firing-pin holder is primarily a forceful axial motion produced by the parachute lanyard, to which it is operatively attached. The primer charge is normally out of angular alignment with the firing pin and the chamber in the housing containing a pyrotechnic charge, but is aligned with a dead-air chamber. However, means for rotating the primer-charge holder is actuated in response to axial motion of the firing-pin holder, so that the primer charge is brought into alignment with the firing pin and pyrotechnic charge before it is struck by the firing pin. In one embodiment, all three of these items are normally mutually out of angular alignment, so that the firing-pin holder must also be rotated. When the firing pin strikes the primer charge, it discharges into the pyrotechnic material which, in turn, discharges hot gases onto the ignition surface of the flare candle.

12 Claims, 6 Drawing Figures

SAFETY IGNITER FOR FLARES

The Government has rights in this invention pursuant to Contract Number F08635-72-C-0145 awarded by the U.S. Air Force.

BACKGROUND OF THE INVENTION

The present invention relates in general to safety ignition means for explosives and incendiary devices. More specifically, it relates to such means that is operable by a lanyard from a parachute.

Illuminating flares are used for a wide variety of military applications; and must be stored on surface ships, submarines, airplanes, etc., where accidental ignition can often be disastrous.

Ignition means for flares and other incendiary devices that is operated by a lanyard attached to a parachute or aircraft are known in the art. Such devices are described in U.S. Pat. Nos. 1,771,455; 3,712,232; and 3,736,877. U.S. Pat. No. 1,771,455 shows a wire 29 that frictionally rubs an ignition device 28 when it is pulled by deployment of the parachute 7, thereby igniting the flare. No attempt is made to avoid accidental ignition, which could happen if the flare were dropped on its parachute end so that weight of the parachute would pull the wire 29. Similarly the inventions shown in U.S. Pat. Nos. 3,712,232 and 3,736,877 could be accidentally ignited if the flares were dropped. Both feature spring-loaded firing pins aimed at primer charges and releasable when a restraining means is removed from the firing pin by the lanyard attached to the parachute. Such restraining means can be removed accidentally from the firing pin under certain conditions either by the inertia of its own mass and/or that of the parachute and lanyard.

SUMMARY OF THE INVENTON

The objects of the present invention, therefore, are to satisfy the safety requirements that have not been met by prior art ignition devices for flares; and to provide a safety igniter for flares that is reliable, simple in construction, and easy to manufacture. A particular object is to provide an igniter that cannot be actuated when the flare is accidentally dropped during ordinary handling.

The invention has a housing having two contiguous bores of different diameters. A primer-charger holder is located, for rotational movement, in the larger bore, and is retained adjacent the shoulder at the juncture of the bores. A primer charge is fixed eccentrically in the primer-charge holder and is normally aligned with a dead-air chamber in the housing. A firing-pin holder, having a firing pin fixed thereto, and extending toward the primer-charge holder, is also located in the larger bore and is operatively attached to a lanyard from the parachute; so that, when the parachute is deployed, the firing-pin holder is moved forcefully toward the primer-charge holder by the lanyard. A means for rotating the primer-charge holder is actuated by this axial movement of the firing-pin holder, so that the primer charge is rotated into alignment with the firing pin and with the inlet port of a pyrotechnic chamber before it is struck by the firing pin.

In one embodiment, the firing-pin is also equipped with rotational means, so that the firing pin, the primer charge, and the pyrotechnic chamber may all be mutually out of alignment until actuated. In this embodiment, deployment of the parachute pulls the lanyard, causing both the firing-pin holder and the primer-charge holder to rotate counter to one another so that the firing pin and primer charge are brought into alignment with the pyrotechnic chamber inlet port before the firing pin strikes the primer charge.

To prevent accidental pull of the lanyard on the firing-pin holder, the lanyard is fixed to the housing by a shear pin that must be broken by a predetermined amount of force before the igniter can be actuated.

Additional advantages and features of the invention will become apparent as the following detailed description is read with reference to the accompanying drawings. The same parts are designated by the same numbers throughout the disclosure.

DESCRIPTION OF THE PREFERRED EMBODIMENTS

Figure 1:
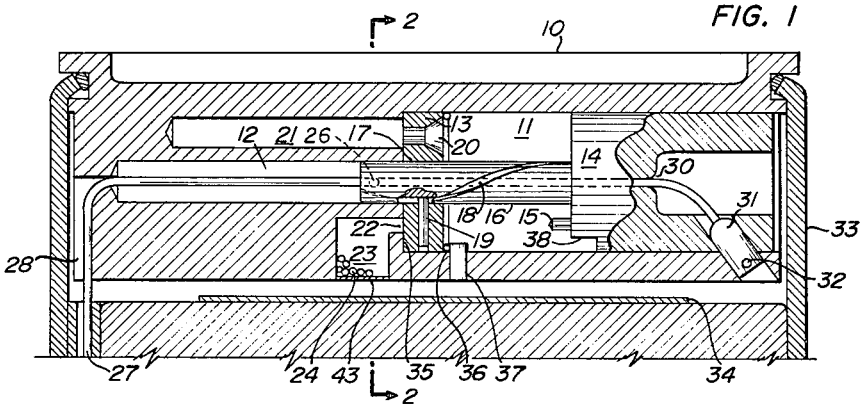
FIG. 1 is a longitudinal section of the invention installed in a typical flare.
Figure 2:
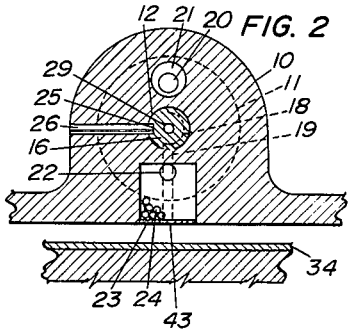
FIG. 2 is a cross section taken on Line 2—2 of FIG. 1.

In reference to FIG. 1, the invention has a housing 10, that provides the end closure for the flare, and has two contiguous bores 11 and 12 of different diameters. The larger bore 11 is preferably open to one end of the housing 10, so that it may receive the primer-charge holder 13 and the firing-pin holder 14, both of which are movable therein. The firing-pin holder 14 is equipped with a firing pin 15 that extends toward the primer-charge holder 13. In this preferred embodiment, a means for rotating the primer-charge holder 13 has the form of a cylinder 16 concentrically fixed to the firing-pin holder passing through a central hole 17 in the primer-charge holder 13. From there, it extends into the smaller bore 12. This cylinder 16 has a helical groove 18 that engages a pin 19 fixed to the primer-charge holder 13, so that, as the cylinder 16 is moved axially through the primer-charge holder 13, the latter is rotated approximately 90° (for convenience of illustration, FIG. 1 shows 180° rotation). This rotation brings the primer charge 20, normally aligned with an empty chamber 21 in the housing 10, into alignment with the inlet port 22 of the chamber 23 containing a pyrotechnic material 24. The cylinder 16 is prevented from rotating as it passes through the primer-charge holder 13 by a straight, longitudinal groove 25 that engages a pin 26 fixed to the housing 10 and extending into the smaller bore 12.

The lanyard 27, attached to the parachute (not shown), enters the housing 10 through a duct 28 and passes through central holes 29 and 30 in the cylinder 16 and the firing-pin holder 14, respectively. The end of the lanyard has a knot, pin, or other obstruction 31 that prevents its passage through the hole 30 in the firing-pin holder 14. A safety feature is provided by a shear pin 32, fixed in the housing 10, that passes hrough the end obstruction 31 of the lanyard 27, so hat it cannot move the firing-pin holder 14 unless a predetermined force, sufficient to break the shear pin 32, is impressed on the lanyard 27.

In operation, the parachute, not shown, becomes deployed shortly after the flare 33 is launched from an aircraft. The shock produced by deployment of the parachute causes the lanyard 27 to break the shear pin 32 and to pull the firing-pin holder 14 forcefully toward the primer-charge holder 13. This causes the primer-charge holder 13 to rotate the primer charge 20 into alignment with the inlet port 22 of the pyrotechnic chamber 23 and the firing pin 15, just before the primer charge 20 is struck by the firing pin 15. When this happens, the primer charge is fired and explosively discharges hot gases into the pyrotechnic charge 24, which ignites and discharges hot gases through its discharge port 43 onto the ignition surface 34 of the flare 33, for ignition thereof.

The primer-charge holder 13 is normally retained in contact with the shoulder 35 at the juncture of the bores 11 and 12 by an "O"-Ring 36, or other elastomeric annulus. This helps to ensure that there is very little leakage of gases between the primer charge 20 and the inlet port 22 of the pyrotechnic chamber 23 when the primer charge is fired. Possible movement of the primer-charge holder 13 toward the firing-pin holder 14 in event that the flare may be dropped accidentally is obviated by a stop means, such as the pin 37 fixed to the housing 10 and extending into the bore 11 adjacent the primer-charge holder 13. A shoulder 38 is provided on the firing-pin holder 14 to provide clearance for the pin 37.

Figure 3:
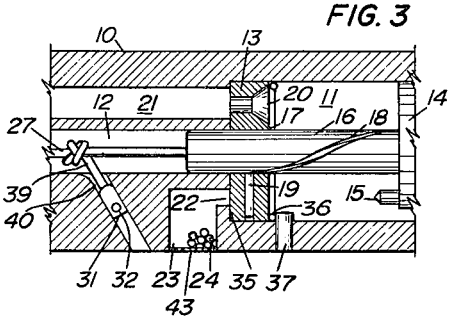
FIG. 3 is a fragmentary longitudinal section of a second embodiment of the invention.

Another means of attaching the lanyard 27 to the firing-pin holder 14 is shown in FIG. 3, wherein an eye fastener 39 is fixed to the end of the cylinder 16. In this arrangement, the central holes 29 and 30 in the cylinder 16 and firing-pin holder 14, respectively, may be eliminated; and the shear pin 32 is located in the housing 10 in a slanted passage 40 adjacent the eye fastener 39. The lanyard 27 passes through the eye fastener 39 to the shear pin 32, which attaches the end obstruction 31 thereof to the housing 10. The lanyard 27 is preferably knotted to the eye fastener 31 to prevent axial movement of the firing-pin holder 14 independently of the lanyard 27.

Figure 4:
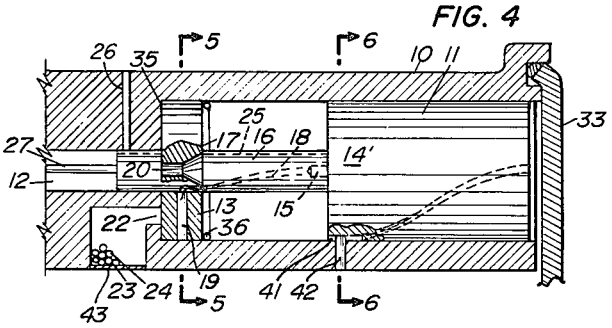
FIG. 4 is similar to FIG. 3, but shows a third embodiment of the invention.
Figure 5:
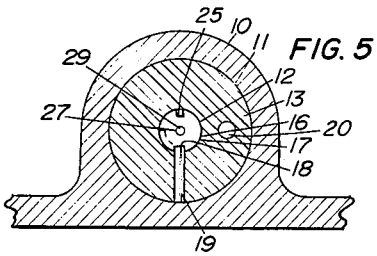
FIG. 5 is a cross section taken on Line 5—5 of FIG. 4.
Figure 6:
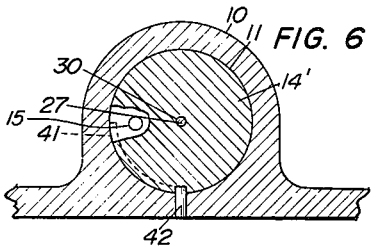
FIG. 6 is a cross section taken on Line 6—6 of FIG. 4.

A third embodiment of the invention is shown in FIG. 4, wherein the primer-charge holder 13, the firing-pin holder 14′ and the pyrotechnic chamber 23 are all normally mutually out of alignment; and wherein the primer-charge holder 13 and the firing-pin holder 14′ must both be rotated in alignment with the inlet port 22 of the pyrotechnic chamber 23 before the firing pin 15 strikes the primer charge 20. To accomplish this, a helical groove 41 in the firing-pin holder 14′ engages a third pin 42 that is fixed to the housing 10 and extends into the larger bore 11. This helical groove 41 is oriented in a direction opposite that of the helical groove 18 on the cylinder 16, so that the firing-pin holder 14′ and the primer-charge holder 13 must rotate in opposite directions to align the primer charge 20 and the firing pin 15 with the inlet port 22. Each of these members is rotated through an angular distance approximately 45° (For clarity of illustration, FIGS. 4, 5, and 6 show 90° rotations). Also, in this embodiment, the cylinder 16 is not attached to the firing-pin holder 14′, since it cannot rotate as the firing-pin holder is rotated, but is nevertheless, moved through the primer-charge holder 13 thereby.

An invention has been described that constitutes an advance in the art of safety ignition for aerial flares. Although the embodiments have been described specifically with regard to detail, it should be noted that many such details may be altered without departing from the scope of the invention as it is defined in the following claims.

For example, in the pins-in-grooves cited herein as being preferred means of controlling rotation of one member relative to translational movement of another, it is readily apparent that the pin may be in either of the members and the groove in the other. Also, the means for rotating the firing-pin holder 14′ (in the embodiment shown in FIG. 4) and the primer-charge holder 13 may be any of the well known devices for converting translational movement into rotational movement, such as gear trains and cams. Also, the shear pin 32 could be replaced by other retraint means, such as bonding.

The invention claimed is:

1. A safety igniter for installation adjacent the ignition surface of an illuminant candle, for ignition thereof, in an aerial flare having a parachute and a lanyard operatively connecting the parachute to the safety igniter, the safety igniter comprising:

a housing having two contiguous bores of different diameters, creating a shoulder at their juncture, a duct leading from the bores to the exterior of the housing for passage of the lanyard, and a pyrotechnic-charge chamber having an inlet port communicating with the larger bore and a discharge port for directing flaming gases onto the ignition surface of the illuminant candle;

a pyrotechnic material in the pyrotechnic-charge chamber;

a primer-charge holder, movable in the larger bore;

a primer charger fixed to the primer-charge holder and being alignable with the inlet port of the pyrotechnic-charge chamber;

means for retaining the primer-charge holder adjacent the shoulder between the bores;

a firing-pin holder, movable in the larger bore, operatively attachable to the lanyard;

a firing pin fixed to the firing-pin holder and extending toward the primer-charge holder;

means for rotating at least the primer-charge holder, as the firing-pin holder is moved toward it by the lanyard, so that the primer charge, normally out of alignment with the inlet port of the pyrotechnic-charge chamber and with the firing pin, is brought into alignment therewith before being struck by the firing pin.

2. The safety igniter of claim 1 wherein the means for rotating the primer-charge holder is a cylinder concentrically fixed to the firing-pin holder, extending through a central hole in the primer-charge holder; a pin, engaging a longitudinal groove, that prevents rotation of the cylinder relative to the housing—the pin being in one of said members and the groove being in the other; and a second pin, engaging a helical groove, causing the primer-charge holder to rotate relative to the cylinder as it slides therethrough—the pin being in one of said members and the groove being in the other.

3. The safety igniter of claim 2 wherein the primer-charge holder rotates the primer charge about 90° from its normal, inoperative position into alignment with the firing pin and inlet port to the pyrotechnic-charge chamber when the igniter is actuated.

4. The safety igniter of claim 1 wherein the means for rotating the primer charge holder is a cylinder concentrically abbutting the firing-pin holder, extending through a central hole in the primer-charge relative to the housing—the pin being in one of said members and the groove being in the other; and a second pin engaging a helical groove, causing the primer-charge holder to rotate relative to the cylinder as it slides therethrough—the pin being in one of said members and the groove being in the other; and further including a third pin, engaging a helical groove that causes the firing-pin holder to rotate as it slides relative to the housing—the pin being in one member and the groove being in the other—this helical groove being oriented so that it rotates the firing-pin holder in a direction opposite the rotation of the primer-charge holder, so that the firing pin and primer charge are brought into alignment with each other and with the inlet of port of the pyrotechnic-charge chamber when the igniter is actuated.

5. The safety igniter of claim 2 wherein the means for retaining the primer-charge holder adjacent the shoulder between the bores is an elastomeric annulus surrounding the clinder.

6. The safety igniter of claim 5 further including a stop means in the larger bore between the primer-charge holder and the firing-pin holder to prevent accidental contact of the primer charge with the firing pin.

7. The safety igniter of claim 1 wherein the housing contains an empty chamber that is in communication with the primer charge in the normal, inoperative position thereof.

8. The safety igniter of claim 2 wherein the lanyard duct is axially oriented and aligns with axial ducts that pass through the cylinder and the firing-pin holder; and including the lanyard, which passes through all three ducts, and an obstruction fixed to the end of the lanyard, that cannot pass through the ducts.

9. The safety igniter of claim 8, further including restraint means that attaches the end of the lanyard to the housing and is broken by the pull on the lanyard when the parachute is deployed.

10. The safety igniter of claim 9 wherein the restraint means is a shear pin.

11. The safety igniter of claim 2 including lanyard attachment means on the end of the cylinder.

12. A safety igniter for a flare having a parachute, comprising:

a housing having two contiguous bores of different diameters, creating a shoulder at their juncture, an empty chamber communicating with the larger bore, a duct leading from the bores to the exterior of the housing, and a pyrotechnic chamber having an inlet port communicating with the larger bore and a discharge port to the exterior of the housing;

a pyrotechnic material in the pyrotechnic chamber;

a primer-charge holder in the larger bore, and having a central hole;

a pin extending into the central hole;

a primer charge fixed to the primer-charge holder, being normally aligned with the empty chamber but alignable with the inlet port of the pyrotechnic-charge chamber;

a firing-pin holder in the larger bore;

a firing pin fixed to the firing-pin holder and extending toward the primer-charge holder;

a cylinder fixed concentrically to the firing-pin holder, having a helical groove that extends an angular distance of about 90° and engages the pin in the primer-charge holder for rotation of the primer charge into alignment with the firing pin and the inlet port to the pyrotechnic chamber;

means for retaining the primer-charge holder in contact with the shoulder between the bores;

a lanyard, attachable to the parachute, and extending through the duct in the housing and through holes in the cylinder and firing-pin holder;

an obstruction fixed to the end of the lanyard that cannot pass through the hole in the firing-pin holder; and restraint means for attaching the obstruction to the housing, that may be broken when the lanyard is pulled by deployment of the parachute.

* * * * *